US007502008B2

(12) United States Patent
Jeoung et al.

(10) Patent No.: US 7,502,008 B2
(45) Date of Patent: Mar. 10, 2009

(54) LIQUID CRYSTAL DISPLAY AND PRE-CHARGING METHOD THEREOF

(75) Inventors: Hun Jeoung, Gyeongsangbuk-do (KR); Sang Ho Kim, Chungcheongnam-do (KR)

(73) Assignee: LG Display Co., Ltd., Seoul (KR)

( * ) Notice: Subject to any disclaimer, the term of this patent is extended or adjusted under 35 U.S.C. 154(b) by 645 days.

(21) Appl. No.: 11/023,341

(22) Filed: Dec. 29, 2004

(65) Prior Publication Data

US 2005/0243043 A1 Nov. 3, 2005

(30) Foreign Application Priority Data

Apr. 30, 2004 (KR) ..... 10-2004-0030338

(51) Int. Cl.
*G09G 3/36* (2006.01)

(52) U.S. Cl. ..... 345/98; 345/100

(58) Field of Classification Search ..... 345/87, 345/98, 100, 204

See application file for complete search history.

(56) References Cited

U.S. PATENT DOCUMENTS

| | | | | |
|---|---|---|---|---|
| 5,973,658 | A | 10/1999 | Kim et al. | |
| 7,079,096 | B2 * | 7/2006 | Washio et al. | 345/100 |
| 7,215,308 | B2 * | 5/2007 | Orii et al. | 345/87 |
| 2003/0030054 | A1 | 2/2003 | Hector et al. | |
| 2003/0107564 | A1 | 6/2003 | Miyazawa | |

* cited by examiner

*Primary Examiner*—Kevin M Nguyen
(74) *Attorney, Agent, or Firm*—Birch, Stewart, Kolasch & Birch, LLP

(57) ABSTRACT

A liquid crystal display and a pre-charging method thereof for pre-charging data lines using a ESD circuit to simplify a circuit configuration are provided. In the method, video lines receiving video signals are floated in a pre-charge interval of time. A pre-charge voltage is supplied to the video lines floated via a static electricity proof circuit connected to the video lines. The pre-charge voltage on the video line is pre-charged by a demultiplexer for making a time-divisional driving of the data lines in a video charge interval of time.

16 Claims, 6 Drawing Sheets

LIQUID CRYSTAL DISPLAY AND PRE-CHARGING METHOD THEREOF

This application claims the priority benefit of Korean Patent Application No. 10-2004-0030338 filed in Republic of Korea on Apr. 30, 2004, which is hereby incorporated by reference.

BACKGROUND OF THE INVENTION

1. Field of the Invention

This invention relates to a liquid crystal display, and more particularly to a liquid crystal display and a pre-charging method thereof wherein data lines can be pre-charged to simplify a circuit configuration.

2. Description of the Related Art

Generally, a liquid crystal display (LCD) controls light transmittance of a liquid crystal in accordance with a video signal to thereby display a picture. The LCD includes a liquid crystal display panel having liquid crystal cells arranged in an active matrix type, and a driving circuit for driving the liquid crystal display panel. The liquid crystal display panel includes a plurality of thin film transistors as switching devices for making an active driving of each liquid crystal cell.

The thin film transistor is classified into an amorphous thin film transistor using amorphous silicon and a polycrystalline thin film transistor using polycrystalline silicon. Herein, the polycrystalline thin film transistor employs polycrystalline silicon having about hundred times faster electric charge mobility than amorphous silicon such that the driving circuit can be built in the liquid crystal display panel.

As shown in FIG. 1, a liquid crystal display panel 18 employing such polycrystalline thin film transistors includes a pixel matrix 16 for displaying a picture, and a plurality of demultiplexers 14 for making a time division of data lines DL of the pixel matrix 16 to supply video signals from an external data driving integrated circuit (D-IC) 10 thereto. Further, the liquid crystal display panel 18 includes a static electricity proof (electro-static discharge ESD) circuit 12 connected to a plurality of video lines VL supplied with video signals from the data D-IC 10 to prevent static electricity.

The pixel matrix 16 includes a liquid crystal cell and a thin film transistor for independently driving the liquid crystal cell for each area defined by the gate lines GL and the data lines DL. The gate lines GL are sequentially driven by a gate D-IC (not shown). The data lines DL charge video signals supplied, via the demultiplexers 14, from the data D-IC 10 every horizontal period when the gate lines GL are driven. The liquid crystal cell reacts a liquid crystal having a dielectric anisotropy by the charged video signals to control light transmittance, thereby implementing a gray level scale. The liquid crystal cell consists of a pixel electrode connected to the corresponding thin film transistor, and a common electrode opposed to the pixel electrode with the liquid crystal therebetween to supply a reference voltage, that is, a common voltage Vcom.

The plurality of demultiplexers 14 divide the data lines DL into a plurality of blocks for their driving. For instance, each of the demultiplexers 14 makes a time-divisional driving of each three data lines DL. Each of the demultiplexers 14 includes first to third sampling switches SW1 to SW3 for sequentially applying video signals supplied, via the video lines VL, from the data D-IC 10 to three data lines DL in response to first to third control signals MUX1 to MUX3 inputted from the exterior thereof.

More specifically, the first to third sampling switches SW1 to SW3 of the demultiplexer 14 are sequentially driven with the first to third control signals MUX1 to MUX3 in a video signal charge interval T2 of a time interval when one gate line GL is turned on as shown in FIG. 2, and applies video signals inputted via the video lines VL to the corresponding data lines DL. Further, the first to third sampling switches SW1 to SW3 of the demultiplexer 14 are turned on at the same time in response to a pre-charge control signal PS included in the first to third control signals MUX1 to MUX3 in a pre-charge interval T1 prior to the charge interval T2 of the video signals of the turn-on interval of the gate line GL. The turned-on first to third sampling switches SW1 to SW3 pre-charge the data lines DL by a pre-charge voltage supplied, via the video lines VL, from the data D-IC 10. The pre-charged data lines DL rapidly charge video signals supplied in the charge interval T2, thereby shortening a charge time of the video signals.

The ESD circuit 12 includes first and second diodes D1 and D2 connected, in series, between the first and second power lines PL1 and PL2. A node between the first and second diodes D1 and D2 is connected to the video line VL. Herein, the first and second diodes D1 and D2 consist of a plurality of thin film transistors. More specifically, when a voltage higher than a first supply voltage Vposi is inputted via the video line VL due to static electricity, the first diode D1 is turned on to thereby discharge the inputted voltage into the first power line PL1. On the other hand, when a voltage lower than a second supply voltage Vnega is inputted due to static electricity, the second diode D2 is turned on to thereby discharge the inputted voltage into the second power line PL2. Thus, it becomes possible to prevent the static electricity from being flown, via the video lines VL, within the liquid crystal display panel 18. Further, when video signals having a value between the first and second supply voltages Vposi and Vnega are supplied via the video lines DL, the first and second diodes D1 and D2 of the ESD circuit 12 are turned off to make no impact on the video signals. For instance, 10V/−8V or 10V/0V is used as the first and second supply voltages Vposi and Vnega, and a voltage in the range of 1V to 9V is applied as a video signal via the video lines VL.

The conventional polycrystalline-type LCD having the above-mentioned structure pre-charges the data lines DL using a pre-charge voltage supplied from the data D-IC 10 mounted onto the exterior side of the liquid crystal display panel 18. In this case, a design of the data D-IC 10 under consideration of the pre-charging becomes complicated. Furthermore, a strategy of configuring a separate pre-charge circuit within the liquid crystal display panel has been suggested, but it brings about a complicated circuit configuration of the liquid crystal display panel.

SUMMARY OF THE INVENTION

Accordingly, it is an object of the present invention to provide a liquid crystal display and a pre-charging method thereof wherein data lines can be pre-charged to simplify a circuit configuration.

In order to achieve these and other objects of the invention, a liquid crystal display device according to one aspect of the present invention includes a liquid crystal display panel including a pixel matrix for displaying a picture; a data driving circuit for applying video signals to the liquid crystal display panel; a static electricity proof circuit, being built in the liquid crystal display panel and connected to a plurality of video lines receiving the video signals from the data driving circuit, for supplying a pre-charge voltage in a pre-charge interval while shutting off static electricity in the remaining interval; and a plurality of demultiplexers, being built in the liquid crystal display panel, for pre-charging the pre-charge voltage supplied via the video lines into the data lines of the pixel matrix in the pre-charge interval while making a time-divisional driving of the data lines to apply video signals via the video lines in a charge interval of the video signals.

A liquid crystal display device according to another aspect of the present invention includes a liquid crystal display panel including a pixel matrix for displaying a picture; a data driving circuit for applying video signals to the liquid crystal display panel; a plurality of demultiplexers, being built in the liquid crystal display panel, for floating data lines of the pixel matrix in a pre-charge interval while making a time division of data lines to apply video signals via video lines in a charge interval of the video signals; and a static electricity proof circuit for pre-charging a pre-charge voltage into the floated data lines in the pre-charge interval while shutting off static electricity in the remaining interval.

A method of pre-charging a liquid crystal display device according to still another aspect of the present invention includes the steps of floating video lines receiving video signals in a pre-charge interval; supplying a pre-charge voltage to the video lines floated via a static electricity proof circuit connected to the video lines; and pre-charging the pre-charge voltage on the video line via a demultiplexer for making a time-divisional driving of the data lines in a video charge interval.

A method of pre-charging a liquid crystal display device according to still another aspect of the present invention includes the steps of floating data lines in a pre-charge interval using a demultiplexer for making a time-divisional driving of the data lines in a video charge interval; and pre-charging a pre-charge voltage into the data lines floated via a static electricity proof circuit connected to the video lines.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

Hereinafter, the preferred embodiments of the present invention will be described in detail with reference to FIGS. 3 to 6.

Figure 1:
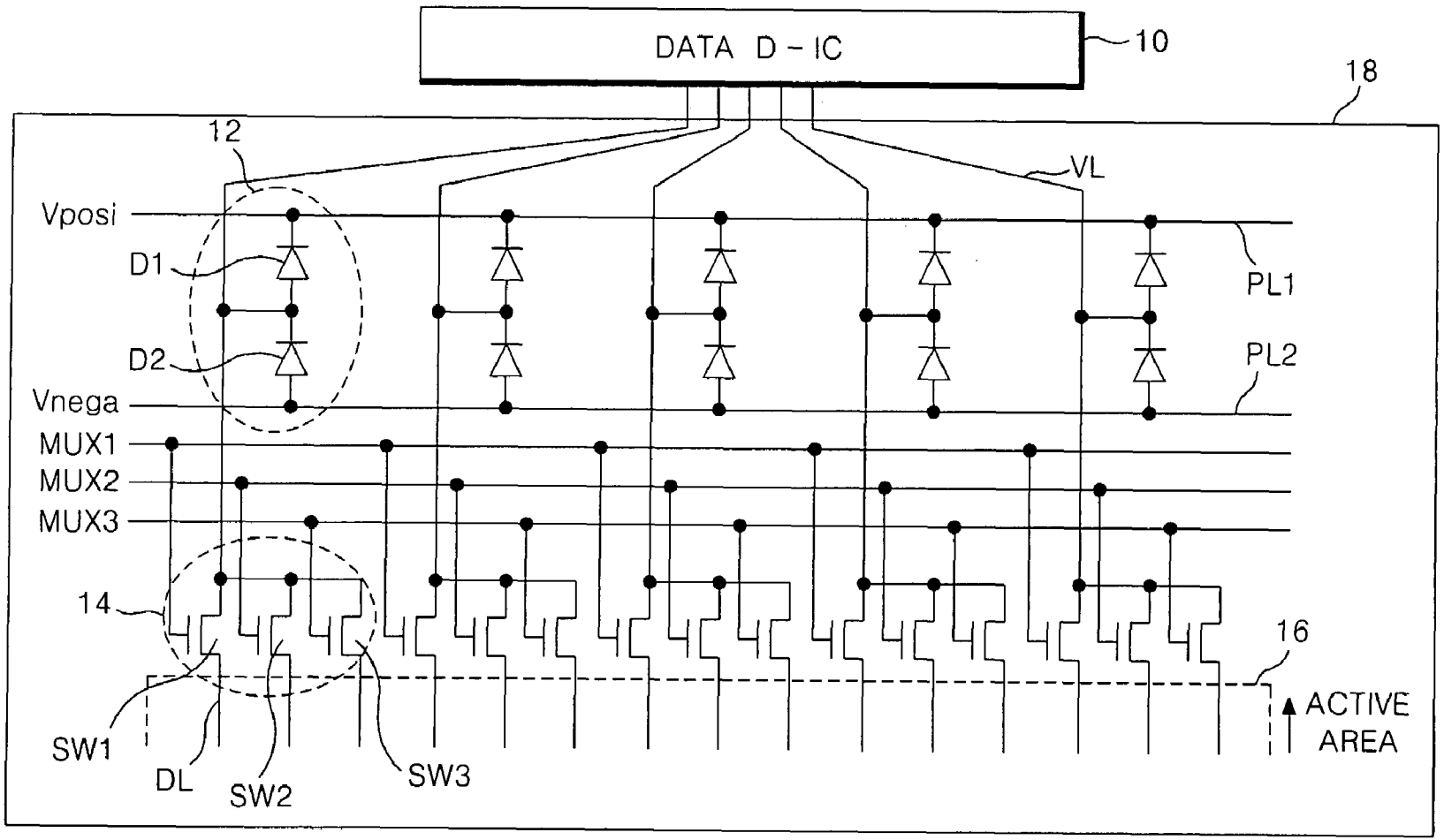
FIG. 1 RELATED ART
FIG. 1 is a block circuit diagram showing a configuration of a polycrystalline-type liquid crystal display according to a related art.
Figure 2:
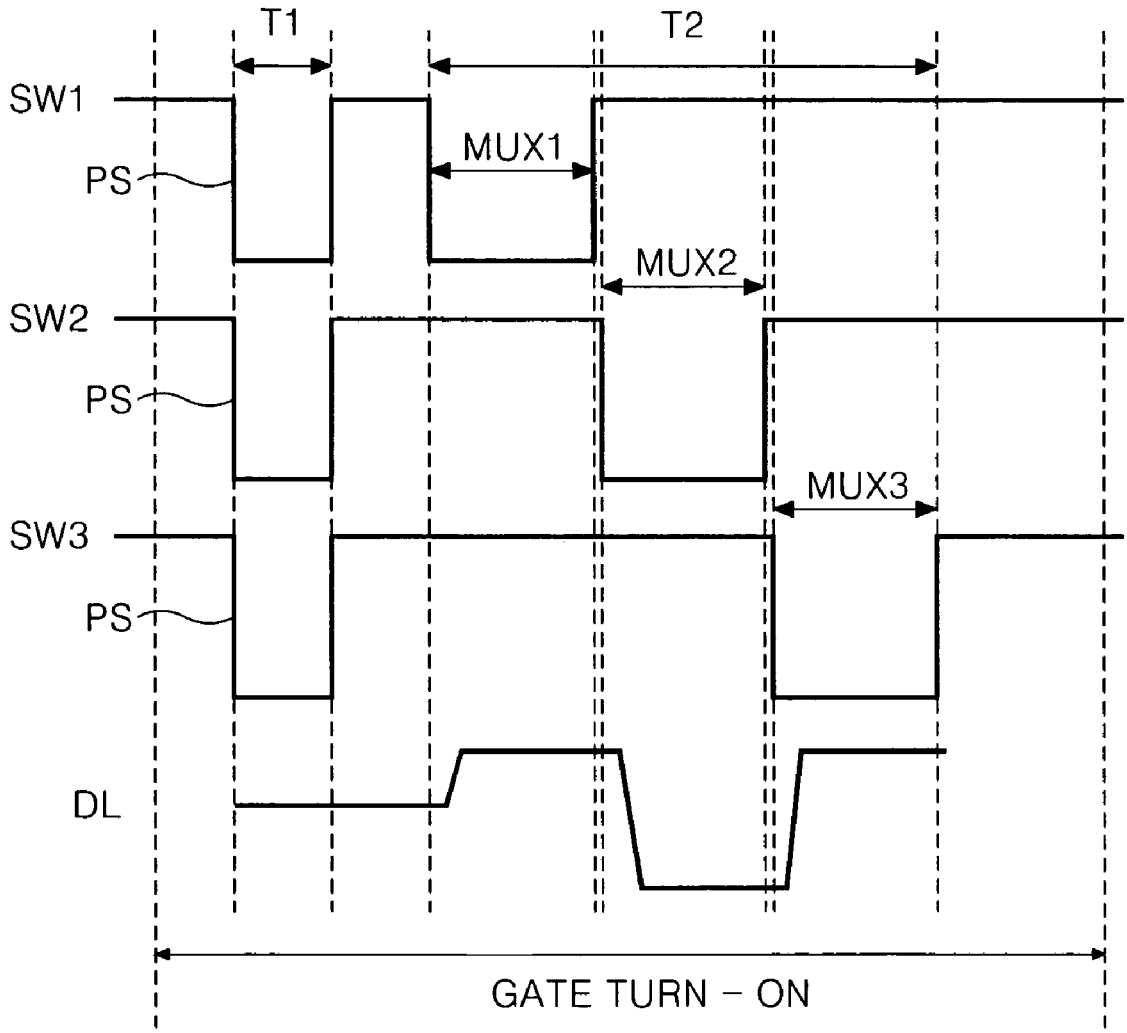
FIG.2 RELATED ART
FIG. 2 is a driving waveform diagram of the liquid crystal display panel shown in FIG. 1.
Figure 3:
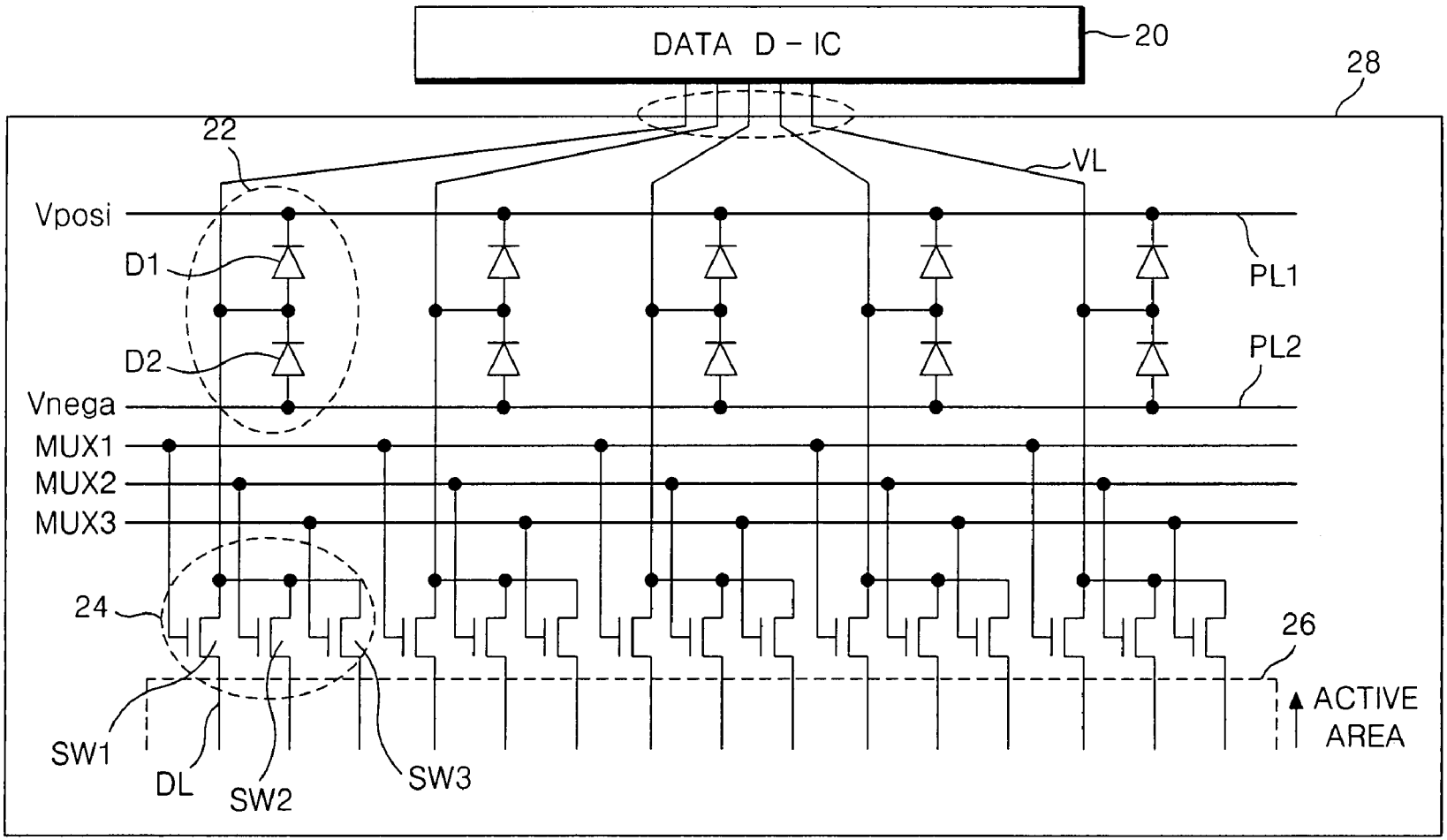
FIG. 3 is a block circuit diagram showing a configuration of a polycrystalline-type liquid crystal display according to a first embodiment of the present invention.
Figure 4:
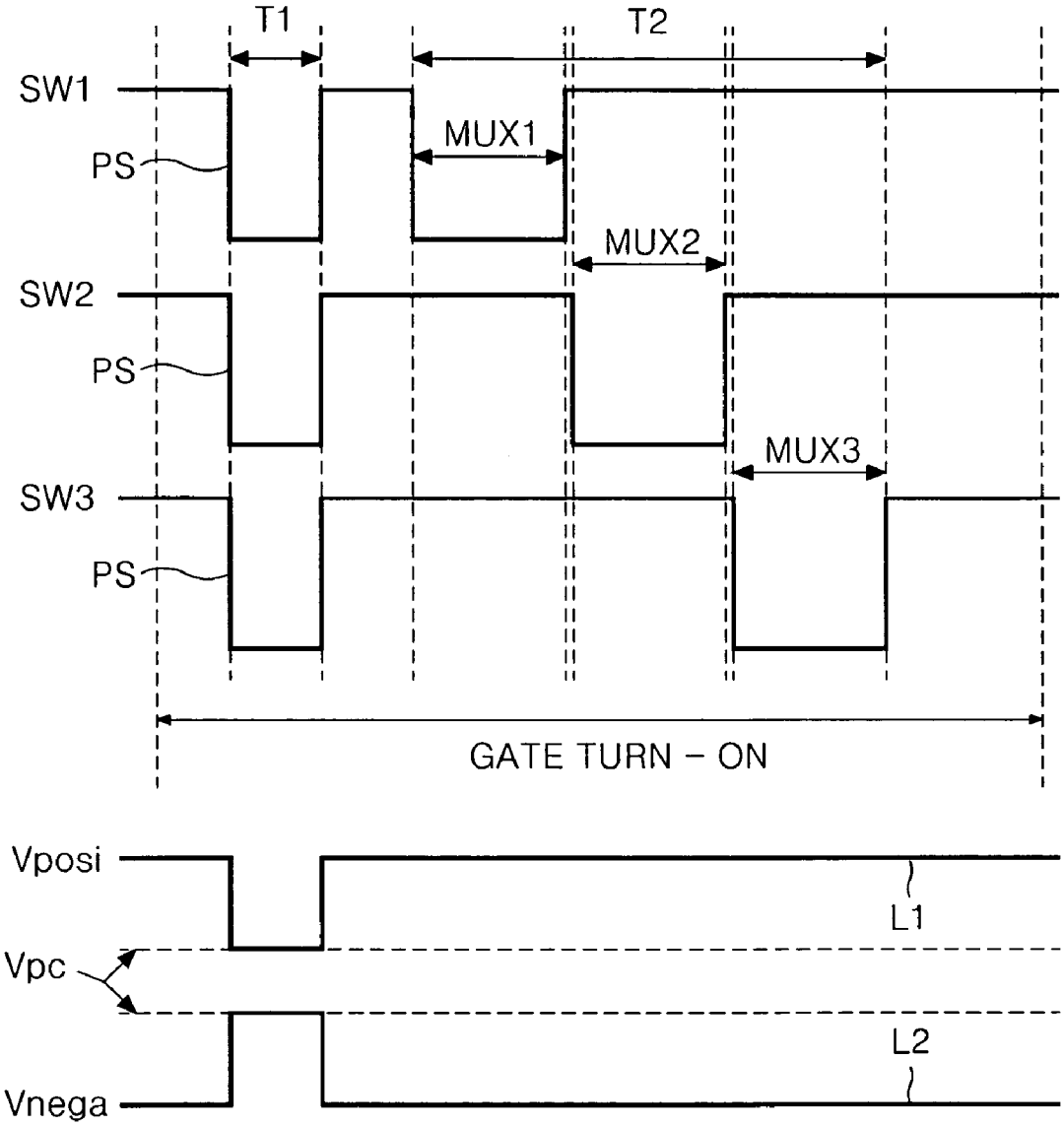
FIG. 4 is a driving waveform diagram of the liquid crystal display panel shown in FIG. 3.

FIG. 3 shows a polycrystalline-type liquid crystal display according to a first embodiment of the present invention, and FIG. 4 is a driving waveform diagram of the liquid crystal display panel shown in FIG. 3.

Referring to FIG. 3, the liquid crystal display (LCD) includes a liquid crystal display panel 28 employing a plurality of polycrystalline thin film transistors, and a data D-IC 20 for applying video signals to the liquid crystal display panel 28.

The liquid crystal display panel 28 includes a pixel matrix 26 for displaying a picture, a plurality of demultiplexer 24 for making a time division of data lines DL of the pixel matrix 26 to supply video signals from the data D-IC 20 thereto, and a static electricity proof (ESD) circuit 22 connected to a plurality of video lines VL supplied with video signals from the data D-IC 20 to prevent static electricity and make a pre-charge.

The pixel matrix 20 includes a liquid crystal cell and a thin film transistor for independently driving the liquid crystal cell for each area defined by the gate lines GL and the data lines DL. The gate lines GL are sequentially driven by a gate D-IC (not shown). The data lines DL charge video signals supplied, via the demultiplexer 24, from the data D-IC 20 every horizontal period when the gate lines GL are driven. Each thin film transistor charges a video signal from the corresponding data line DL into the liquid crystal cell in response to a scanning signal from the corresponding gate line GL. The liquid crystal cell reacts a liquid crystal having a dielectric anisotropy by the charged video signals to control light transmittance, thereby implementing a gray level scale. The liquid crystal cell includes a pixel electrode connected to the corresponding thin film transistor, and a common electrode opposed to the pixel electrode with the liquid crystal therebetween to supply a reference voltage, that is, a common voltage Vcom.

The plurality of demultiplexers 24 divide the data lines DL into a plurality of blocks for their driving. For instance, each of the demultiplexers 24 makes a time-divisional driving of each three data lines DL. Each of the demultiplexers 24 includes first to third sampling switches SW1 to SW3 for sequentially applying video signals supplied, via the video lines VL, from the data D-IC 20 to the three data lines DL in response to first to third control signals MUX1 to MUX3 inputted from the exterior thereof.

More specifically, the first, to third sampling switches SW1 to SW3 of the demultiplexer 24 are sequentially driven with the first to third control signals MUX1 to MUX3 in a video signal charge interval T2 of a time interval when one gate line GL is turned on as shown in FIG. 4, and applies video signals inputted via the video lines VL to the corresponding data lines DL. Further, the first to third sampling switches SW1 to SW3 of the demultiplexer 24 are turned on at the same time in response to a pre-charge control signal PS included in the first to third control signals MUX1 to MUX3 in a pre-charge interval T1 prior to the charge interval T2 of the video signals of the turn-on interval of the gate line GL. The turned-on first to third sampling switches SW1 to SW3 pre-charge the data lines DL by a pre-charge voltage (Vps) supplied from the ESD circuit 22. As a result, the pre-charged data lines DL rapidly charge video signals supplied in the charge interval T2, thereby shortening a charge time of the video signals.

The ESD circuit 22 includes first and second diodes D1 and D2 connected, in series, between first and second power lines PL1 and PL2. For each video line VL, a node between the first and second diodes D1 and D2 is connected to the video line VL. Herein, the first and second diodes D1 and D2 include a plurality of thin film transistors.

According to the present invention, the ESD circuit 22 supplies a pre-charge voltage (Vps) to the video lines VL in the pre-charge interval T1 while playing a role to shut off static electricity in the remaining interval. More specifically, the data D-IC 20 floats the video lines VL in the pre-charge interval T1. During the pre-charge interval T1, the first and second power lines PL1 and PL2 supply the pre-charge voltage Vpc that is lower than a first supply voltage Vposi and higher than a second supply voltage Vnega. In other words, the first and second supply voltages Vposi and Vnega respectively provided by the power lines PL1 and PL2 are at certain levels (L1 and L2 in FIG. 4) prior to the pre-charge interval T1. Then during the pre-charge interval T1, the levels of Vposi and Vnega are changed to lower and higher levels respectively, wherein such changed levels function as the pre-charge voltage Vpc. After the pre-charge interval T1, such as during the charge interval T2, the levels of Vposi and Vnega are changed back to the previous levels L1 and L2 as shown in FIG. 4.

If the pre-charge voltage Vpc is supplied, then the first and second diodes D1 and D2 are turned on to thereby pre-charge the floated video lines VL into the pre-charge voltage Vpc. The pre-charge voltage Vpc on the video line VL is pre-charged, via the demultiplexer 24 in which all of the first to third sampling switches SW1 to SW3 are turned on by the pre-charge control signal PS, into the data line DL. For instance, 10V/−8V or 10V/0V is used as the first and second supply voltages Vposi and Vnega, and a common voltage of 5V referenced upon driving of the liquid crystal cell may be applied as the pre-charge voltage Vpc.

The first and second power lines PL1 and PL2 are supplied with the original levels of the first and second supply voltages Vposi and Vnega, respectively, in the remaining interval other than the pre-charge interval T1. In this case, if a voltage higher than the first supply voltage Vposi is inputted via the video line VL due to static electricity, then the first diode D1 is turned on to discharge the inputted voltage into the first power line PL1. On the other hand, if a voltage lower than the second supply voltage Vnega is inputted via the video line VL due to static electricity, then the second diode D2 is turned on to discharge the inputted voltage into the second power line PL2. Thus, it becomes possible to prevent static electricity from being inputted, via the video line VL, into the interior of the liquid crystal display panel 28. Further, if a video signal having a value between the first and second supply voltages Vposi and Vnega is supplied via the video line VL in the charge interval T2 of the video signal, then the first and second diodes D1 and D2 of the ESD circuit 22 are turned off and thus do not affect or influence the video signal. As an example, a voltage in the range of 1V to 9V may be applied as the video signal.

As mentioned above, the LCD according to the first embodiment of the present invention pre-charges the data line DL using the ESD circuit 22 built in the liquid crystal display panel 28, thereby simplifying a circuit configuration of the data D-IC 20 and the interior of the liquid crystal display panel 28.

Figure 5:
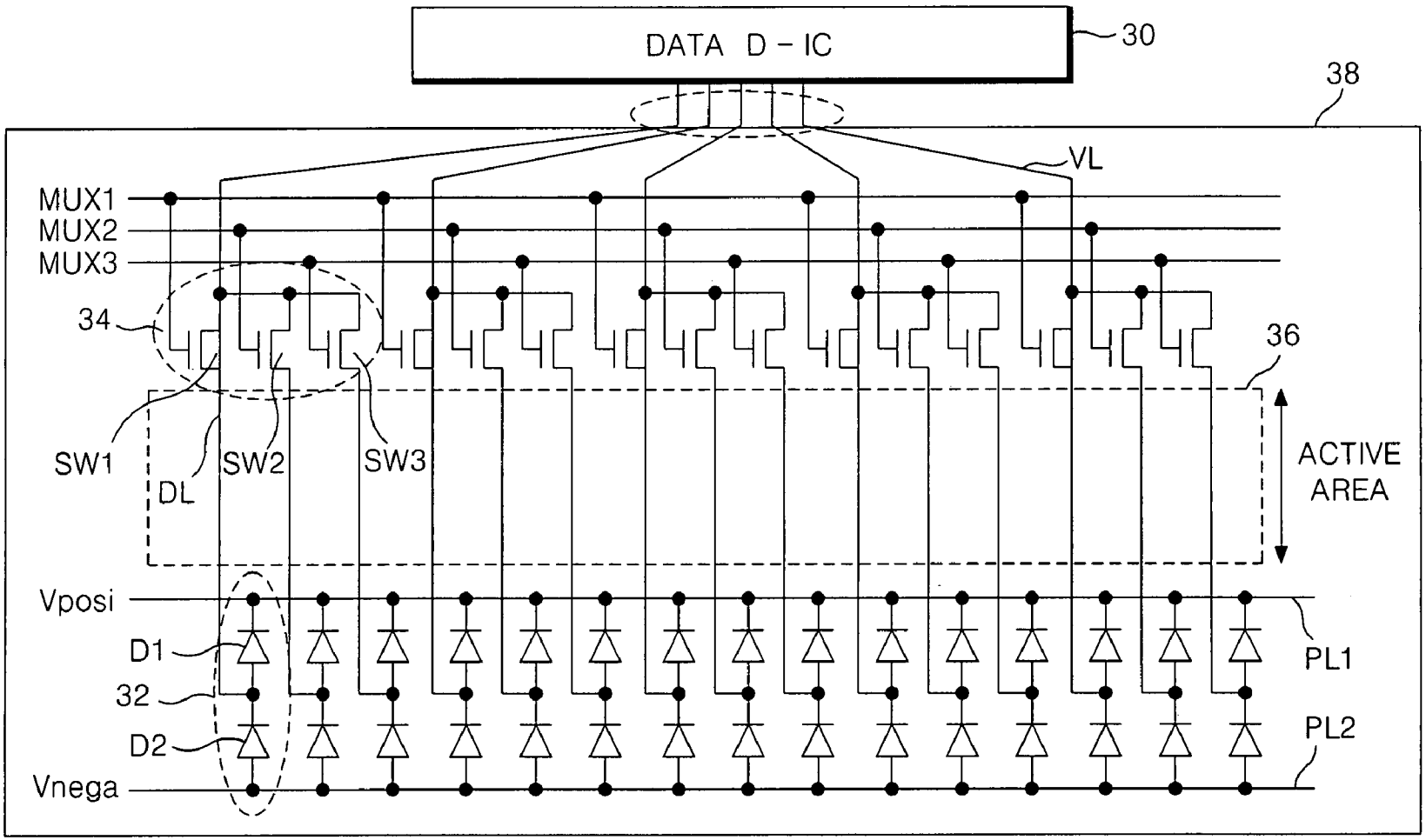
FIG. 5 is a block circuit diagram showing a configuration of a polycrystalline-type liquid crystal display according to a second embodiment of the present invention.
Figure 6:
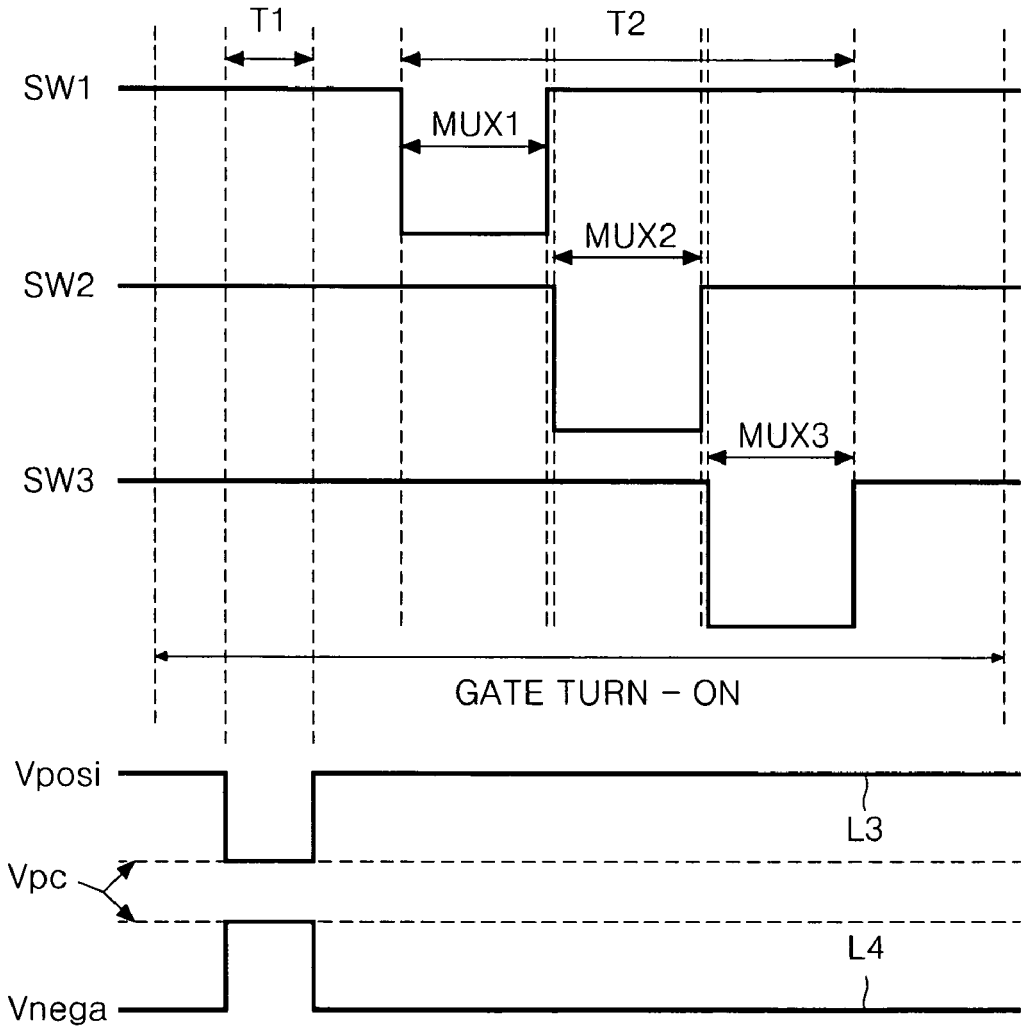
FIG. 6 is a driving waveform diagram of the liquid crystal display panel shown in FIG. 5.

FIG. 5 shows a polycrystalline-type liquid crystal display according to a second embodiment of the present invention, and FIG. 6 is a driving waveform diagram of the liquid crystal display panel shown in FIG. 5.

Referring to FIG. 5, the liquid crystal display (LCD) includes a liquid crystal display panel 38 employing a plurality of polycrystalline thin film transistors, and a data D-IC 30 for applying video signals to the liquid crystal display panel 38.

The liquid crystal display panel 38 includes a pixel matrix 36 (active area) for displaying a picture, a plurality of demultiplexer 34 for making a time division of data lines DL of the pixel matrix 36 to supply video signals from the data D-IC 30 thereto, and an ESD circuit 32 connected to a lower side of each data line DL to prevent static electricity and make a pre-charge. That is, the demultiplexers 34 and the ESD circuit 32 are located at opposite sides of the pixel matrix 36.

The pixel matrix 36 includes a liquid crystal cell and a thin film transistor for independently driving the liquid crystal cell for each area defined by the gate lines GL and the data lines DL. The gate lines GL are sequentially driven by a gate D-IC (not shown). The data lines DL charge video signals supplied, via the demultiplexer 34, from the data D-IC 30 every horizontal period when the gate lines GL are driven. Each thin film transistor charges a video signal from the corresponding data line DL into the liquid crystal cell in response to a scanning signal from the corresponding gate line GL. The liquid crystal cell reacts a liquid crystal having dielectric anisotropy by the charged video signals to control light transmittance, thereby implementing a gray level scale. Each liquid crystal cell includes a pixel electrode connected to the corresponding thin film transistor, and a common electrode opposed to the pixel electrode with the liquid crystal therebetween to supply a reference voltage, that is, a common voltage Vcom.

The plurality of demultiplexers 34 divide the data lines DL into a plurality of blocks for their driving. For instance, each of the demultiplexers 34 makes a time-divisional driving of each three data lines DL. Each of the demultiplexers 34 includes first to third sampling switches SW1 to SW3 for sequentially applying video signals supplied, via the video lines VL, from the data D-IC 30 to the three data lines DL in response to first to third control signals MUX1 to MUX3 inputted from the exterior thereof.

More specifically, the first to third sampling switches SW1 to SW3 of the demultiplexer 34 are sequentially driven with the first to third control signals MUX1 to MUX3 in a video signal charge interval T2 of a time interval when one gate line GL is turned on as shown in FIG. 6, and applies video signals inputted via the video lines VL to the corresponding data lines DL.

Further, the demultiplexer 34 is turned off in a pre-charge interval T1 prior to the charge interval T2 of the video signals of the turn-on interval of the gate line GL to thereby float the data lines DL. Then a pre-charge voltage Vpc supplied via the ESD circuit 32 connected to the lower side thereof is pre-charged into the floated data lines DL.

The pre-charged data lines DL then rapidly charge video signals supplied in the charge interval T2, thereby shortening a charge time of the video signals.

The ESD circuit 32 includes first and second diodes D1 and D2 connected, in series, between first and second power lines PL1 and PL2. Each node between the first and second diodes D1 and D2 is connected to the corresponding data line DL, the switch SW2 or the switch SW3. Herein, the first and second diodes D1 and D2 can include a plurality of thin film transistors. The ESD circuit 32 supplies the pre-charge voltage Vpc to the video lines VL in the pre-charge interval T1 while playing a role to shut off static electricity in the remaining interval.

More specifically, the demultiplexer 34 floats the data lines DL in the pre-charge interval T1 by being turned off, and the first and second power lines PL1 and PL2 respectively supply a pre-charge voltage Vpc lower than a first supply voltage Vposi and higher than a second supply voltage Vnega. That is, the first and second supply voltages Vposi and Vnega (at levels L3 and L4) supplied respectively on the first and second power lines PL1 and PL2 decrease and increase, respectively, to provide the pre-charge voltage Vpc during the pre-charge interval T1 as shown in FIG. 6. If the pre-charge voltage Vpc is supplied, then the first and second diodes D1 and D2 of the ESD circuit 32 are turned on to thereby pre-charge each of the floated data lines DL into the pre-charge voltage Vpc. For instance, 10V/−8V or 10V/0V is used as the first and second supply voltages Vposi and Vnega, and a common voltage of 5V referenced upon driving of the liquid crystal cell is applied as the pre-charge voltage Vpc.

The first and second power lines PL1 and PL2 supply the first and second supply voltages Vposi and Vnega at levels L3 and L4, respectively, in the remaining interval other than the pre-charge interval T1. In this case, if a voltage higher than the first supply voltage Vposi (L3) is inputted via the data line DL due to static electricity, then the first diode D1 is turned on to discharge the inputted voltage into the first power line PL1. On the other hand, if a voltage lower than the second supply voltage Vnega (L4) is inputted via the data line DL due to static electricity, then the second diode D2 is turned on to discharge the inputted voltage into the second power line PL2. Thus, it becomes possible to prevent static electricity from being inputted, via the video lines VL, into the interior of the liquid crystal display panel 38. Further, if a video signal having a value between the first and second supply voltages Vposi and Vnega (L3 and L4) is supplied via the video line VL in the charge interval T2 of the video signal, then the first and second diodes D1 and D2 of the ESD circuit 32 are turned off and thus do not affect or influence the video signal. As an example, a voltage in the range of 1V to 9V may be applied as the video signal.

As mentioned above, the LCD according to the second embodiment of the present invention pre-charges the data line DL using the ESD circuit 32 built in the liquid crystal display panel 38, thereby simplifying a circuit configuration of the data D-IC 30 and the interior of the liquid crystal display panel 38.

As described above, according to the present invention, the data lines are pre-charged with the aid of the ESD circuit built in the liquid crystal display panel, thereby simplifying a circuit configuration of the data D-IC and the interior of the liquid crystal display panel.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display device, comprising:

a liquid crystal display panel including a pixel matrix for displaying a picture;

a data driving circuit for applying video signals to the liquid crystal display panel;

a static electricity proof circuit in the liquid crystal display panel and connected to a plurality of video lines receiving the video signals from the data driving circuit, for supplying the video lines with a pre-charge voltage in a pre-charge time interval while shutting off static electricity in the remaining time interval; and a plurality of demultiplexers in the liquid crystal display panel, for pre-charging the pre-charge voltage supplied via the video lines into data lines of the pixel matrix in the pre-charge time interval while making a time-divisional driving of the data lines to apply the video signals in a charge time interval of the video signals, wherein the data driving circuit floats the video lines in the pre-charge time interval, wherein a supplying time of the pre-charge voltage is synchronized with a floating time of the video lines.

2. The liquid crystal display device according to claim 1, wherein the static electricity proof circuit includes:

first and second diodes connected, in series, between first and second power lines.

3. The liquid crystal display device according to claim 2, wherein the first and second power lines commonly supply the pre-charge voltage in the pre-charge time interval while supply first and second supply voltages in the remaining time interval, wherein a node between the first and second diodes is connected to one of the video lines.

4. The liquid crystal display device according to claim 3, wherein the first and second supply voltages are respectively higher and lower than the pre-charge voltage.

5. The liquid crystal display device according to claim 2, wherein the first and second diodes are turned on by the pre-charge voltage to thereby supply the pre-charge voltage to the floated video lines.

6. The liquid crystal display device according to claim 1, wherein the pre-charge voltage is identical to a common voltage supplied to the pixel matrix.

7. A liquid crystal display device, comprising:

a liquid crystal display panel including a pixel matrix for displaying a picture;

a data driving circuit for applying video signals to the liquid crystal display panel;

a plurality of demultiplexers in the liquid crystal display panel, for floating data lines of the pixel matrix in a pre-charge time interval while making a time division of the data lines to apply the video signals via video lines in a charge time interval of the video signals; and a static electricity proof circuit for pre-charging a pre-charge voltage into the floated data lines in the pre-charge time interval while shutting off static electricity in the remaining time interval, wherein a pre-charging time of the pre-charge voltage is synchronized with a floating time of the data lines.

8. The liquid crystal display device according to claim 7, wherein the static electricity proof circuit includes:

first and second diodes connected, in series, between first and second power lines.

9. The liquid crystal display device according to claim 8, wherein the first and second power lines commonly supply the pre-charge voltage in the pre-charge time interval while supply first and second supply voltages in the remaining time interval, wherein a node between the first and second diodes is connected to one of the data lines.

10. The liquid crystal display device according to claim 9, wherein the first and second supply voltages are respectively higher and lower than the pre-charge voltage.

11. The liquid crystal display device according to claim 8, wherein the first and second diodes are turned on by the pre-charge voltage to thereby supply the pre-charge voltage to the floated data lines.

12. The liquid crystal display device according to claim 7, wherein the pre-charge voltage is identical to a common voltage supplied to the pixel matrix.

13. A method of pre-charging a liquid crystal display device including a pixel matrix for displaying a picture, comprising the steps of:

floating video lines receiving video signals using a data driving circuit in a pre-charge time interval;

supplying a pre-charge voltage to the video lines floated using a static electricity proof circuit connected to the video lines;

pre-charging the pre-charge voltage supplied via the video lines into data lines of the pixel matrix using a plurality of demultiplexers in the pre-charge time interval; and making a time-divisional driving of the data lines to apply the video signals using the demultiplexers in a charge time interval of the video charge, wherein a supplying time of the pre-charge voltage is synchronized with a floating time of the video lines.

14. The method according to claim 13, wherein the static electricity proof circuit is turned on by the pre-charge voltage being lower than a first supply voltage but higher than a second supply voltage in the pre-charge time interval, thereby supplying the pre-charge voltage.

15. A method of pre-charging a liquid crystal display device, comprising the steps of:

floating data lines using a plurality of demultiplexers in a pre-charge time interval;

pre-charging a pre-charge voltage into the data lines floated using a static electricity proof circuit in the pre-charge time interval; and making a time-divisional driving of the data lines to apply the video signals using the demultiplexers in a charge time interval of the video signals, wherein the pre-charging time of the pre-charge voltage is synchronized with the floating time of the data lines.

16. The method according to claim 15, wherein the static electricity proof circuit is turned on by the pre-charge voltage being lower than a first supply voltage but higher than a second supply voltage in the pre-charge time interval, thereby supplying the pre-charge voltage.

* * * * *